US009246209B2

(12) United States Patent
Han et al.

(10) Patent No.: US 9,246,209 B2
(45) Date of Patent: Jan. 26, 2016

(54) ANTENNA AND FRONT END MODULE

(71) Applicant: SAMSUNG ELECTRO-MECHANICS CO., LTD., Suwon, Gyunggi-do (KR)

(72) Inventors: Myeong Woo Han, Gyunggi-do (KR); Young Jean Song, Gyunggi-do (KR); Jun Goo Won, Gyunggi-do (KR); Shinichi Iizuka, Gyunggi-do (KR); Youn Suk Kim, Gyunggi-do (KR); Ki Joong Kim, Gyunggi-do (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 244 days.

(21) Appl. No.: 13/777,595

(22) Filed: Feb. 26, 2013

(65) Prior Publication Data

US 2014/0176392 A1 Jun. 26, 2014

(30) Foreign Application Priority Data

Dec. 20, 2012 (KR) ..... 10-2012-0149940

(51) Int. Cl.
*H01Q 1/38* (2006.01)
*H01Q 1/22* (2006.01)
*H01Q 9/04* (2006.01)

(52) U.S. Cl.
CPC ..... *H01Q 1/2283* (2013.01); *H01Q 9/0407* (2013.01)

(58) Field of Classification Search
CPC ..... H01Q 1/2283
USPC ..... 343/700 MS; 257/690, 693
See application file for complete search history.

(56) References Cited

U.S. PATENT DOCUMENTS

| | | | | |
|---|---|---|---|---|
| 7,369,090 | B1 * | 5/2008 | Beard | 343/702 |
| 7,692,588 | B2 * | 4/2010 | Beer et al. | 343/700 MS |
| 8,319,298 | B2 * | 11/2012 | Hsu | 257/428 |
| 8,451,618 | B2 * | 5/2013 | Boeck et al. | 361/764 |
| 2008/0291115 | A1 | 11/2008 | Doan et al. | |
| 2009/0160717 | A1 * | 6/2009 | Tsutsumi et al. | 343/726 |
| 2010/0193935 | A1 * | 8/2010 | Lachner et al. | 257/693 |
| 2011/0170231 | A1 * | 7/2011 | Chandrasekaran et al. | 361/306.1 |

FOREIGN PATENT DOCUMENTS

| | | | |
|---|---|---|---|
| JP | 2003-288569 | A | 10/2003 |
| KR | 10-2004-0025680 | | 3/2004 |
| KR | 10-2006-0020498 | A | 3/2006 |
| KR | 10-2011-0049544 | A | 5/2011 |
| WO | 02/093685 | A1 | 11/2002 |

OTHER PUBLICATIONS

Notice of Office Action Korean Patent Application No. 10-2012-0149940 dated Sep. 24, 2013.

* cited by examiner

*Primary Examiner* — Tho G Phan
(74) *Attorney, Agent, or Firm* — NSIP Law

(57) ABSTRACT

There are provided an antenna and a front end module having an air cavity formed therein and shortening a connection distance with a signal processing module to improve radiation characteristics and facilitate a manufacturing process thereof, the antenna including a substrate having a preset mounting surface, an antenna pattern part formed on the mounting surface of the substrate and transmitting and receiving a signal within a preset frequency band, and a solder ball group having a plurality of solder balls formed on the mounting surface of the substrate to fix the substrate to an external circuit board and disposed at preset intervals around the antenna pattern part to form an air cavity.

12 Claims, 3 Drawing Sheets

ANTENNA AND FRONT END MODULE

CROSS-REFERENCE TO RELATED APPLICATIONS

This application claims the priority of Korean Patent Application No. 10-2012-0149940 filed on Dec. 20, 2012, in the Korean Intellectual Property Office, the disclosure of which is incorporated herein by reference.

BACKGROUND OF THE INVENTION

1. Field of the Invention

The present invention relates to an antenna and a front end module able to transmit and receive a signal within a millimeter wave band.

2. Description of the Related Art

Recently, domestic and international research into next-generation Wi-Fi networks (80.11b/a/g/n) in a 2.4 GHz/5 GHz frequency band and 801.11ad (WiGig) in a 60 GHz band (millimeter wave (mmWave)) able to transmit large-capacity data has been actively undertaken.

Generally, in the case of the foregoing 801.11b/a/g/n network standard, an antenna that transmits and receives a signal is generally installed on the outside of the module.

However, in the case of the 801.11ad network standard, as a distance between an antenna and signal processing module is increased, radiation loss is increased. Therefore, there is a need for a design to allow for a reduction in loss by significantly decreasing the distance.

Further, it is essential to use a process with a low error rate during a manufacturing process.

Meanwhile, in the related art, a method of manufacturing an antenna using a separate substrate and attaching a signal processing module thereto is generally used, as in the invention disclosed in the following prior art.

In the method known as antenna in package (AIP), several circuits, various peripheral parts, and various connectors are attached to module substrates, such as LTCC, HTCC, Teflon, and the like, by using an SMT process.

For example, when an error of ±10% occurs in an actual manufacturing process at the time of using an LTCC manufacturing process, a resonance point may be shifted by about ±1 to 2 GHz, based on a signal within a millimeter wave band, a feeding structure may be complicated, and a degradation in performance may occur due to a mismatch between an antenna patch and a feeding line, such that it may be difficult to analyze causes of degradation in performance.

In addition, when the antenna and the signal processing module are connected to each other by a bonding wire, as described above, as the distance between the antenna and the signal processing module is increased, radiation loss is increased, such that radiation characteristics may be deteriorated.

RELATED ART DOCUMENT (Patent Document 1) US Patent Laid-Open Publication No. US20080291115

SUMMARY OF THE INVENTION

An aspect of the present invention provides an antenna and a front end module having an air cavity formed therein and a reduced connection distance with a signal processing module to improve radiation characteristics and facilitate the manufacturing thereof.

According to an aspect of the present invention, there is provided an antenna, including: a substrate having a preset mounting surface; an antenna pattern part formed on the mounting surface of the substrate and transmitting and receiving a signal within a preset frequency band; and a solder ball group having a plurality of solder balls formed on the mounting surface of the substrate to fix the substrate to an external circuit board and disposed at preset intervals around the antenna pattern part to form an air cavity.

The antenna may further include: a feeding pattern part formed on the mounting surface of the substrate and electrically connected to the antenna pattern part to supply electricity.

The signal transmitted and received through the antenna pattern part may be a millimeter wave band signal.

A distance between a center of one solder ball and a center of another solder ball adjacent thereto among the plurality of solder balls may be smaller than 0.1 times a product of a wavelength of the signal and a preset permittivity.

The respective solder balls of the solder ball group may be disposed along a perimeter of the substrate.

According to another aspect of the present invention, there is provided a front end module, including: a circuit board having one surface on which a mounting area is provided; an antenna including a substrate having a preset mounting surface facing the mounting area of the circuit board, an antenna pattern part formed on the mounting surface of the substrate and transmitting and receiving a signal within a preset frequency band, and a solder ball group having a plurality of solder balls formed on the mounting surface of the substrate to fix the substrate to the mounting area of the circuit board and disposed at preset intervals around the antenna pattern part to form an air cavity; and a signal processing integrated circuit mounted on the mounting area of the circuit board to process the signal transmitted and received through the antenna.

The mounting area of the circuit board may be provided with a connection pattern part that transmits the signal between the antenna and the signal processing integrated circuit.

The antenna may further include a feeding pattern part formed on the mounting surface of the substrate and electrically connected to the antenna pattern part to supply electricity, and at least one solder ball in the solder ball group may electrically connect the feeding pattern part to the connection pattern part.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE EMBODIMENTS

Figure 1:
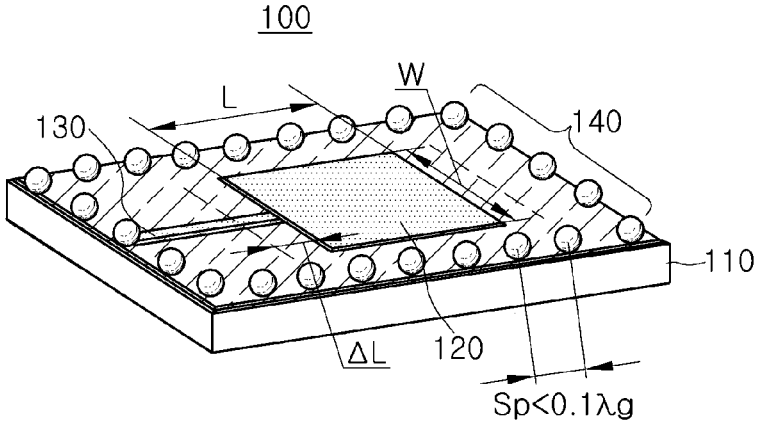
FIG. 1 is a schematic configuration diagram of an antenna according to an embodiment of the present invention.

Hereinafter, embodiments of the present invention will be described in detail with reference to the accompanying drawings. The invention may, however, be embodied in many different forms and should not be construed as being limited to the embodiments set forth herein. Rather, these embodiments are provided so that this disclosure will be thorough and complete, and will fully convey the scope of the invention to those skilled in the art. In the drawings, the shapes and dimensions of elements may be exaggerated for clarity, and the same reference numerals will be used throughout to designate the same or like elements.

FIG. 1 is a schematic configuration diagram of an antenna according to an embodiment of the present invention.

Referring to FIG. 1, an antenna 100 according to an embodiment of the present invention may include a substrate 110, an antenna pattern part 120, a feeding pattern part 130, and a solder ball group 140.

The substrate 110 may be formed of a dielectric substance such as a ceramic and have one surface and the other surface opposite to the one surface.

At least one of the both surfaces may be a surface on which components may be mounted or formed and the mounting surface may have the antenna pattern part 120, the feeding pattern part 130, and the solder ball group 140 formed or disposed thereon.

The antenna pattern part 120 may be configured of a conductor that may transmit and receive a signal within a preset frequency band and the shape thereof may be varied.

For example, as illustrated in FIG. 1, the antenna pattern part may be formed as a quadrangular patch antenna pattern.

A resonance frequency of the antenna pattern part may depend on the following Equation 1.

$$f_0 = \frac{c}{2L\sqrt{\varepsilon_f}} \quad \text{[Equation 1]}$$

In the above Equation 1, L represents a length of the antenna pattern part, $\in_f$ represents effective permittivity, and c represents a speed of light in a free space.

The foregoing effective permittivity may be represented by the following Equation 2.

$$\varepsilon_f = \frac{\varepsilon_r + 1}{2} + \frac{\varepsilon_r - 1}{2}\left(1 + \frac{12h}{W}\right)^{-\frac{1}{2}} \quad \text{[Equation 2]}$$

In the above Equation 2, $\in_r$ represents permittivity of the substrate 110.

In order for the antenna pattern part to be operated in a preset basic mode TM10, a length of the antenna pattern part needs to be slightly smaller than a half wavelength due to a freezing effect.

Herein, the wavelength represents a wavelength within a dielectric substance and may depend on the following Equation 3.

$$\lambda = \lambda_0/\sqrt{\in_f} \quad \text{[Equation 3]}$$

A structure of a radiating slot may be analyzed in a length direction of the feeding pattern part. A length ΔL electrically extending from each termination of the antenna pattern part may depend on the following Equation 4.

$$\Delta L = 0.412 \times \frac{(\varepsilon_f + 0.3)\left(\frac{W}{h} + 0.264\right)}{(\varepsilon_f - 0.258)\left(\frac{W}{h} + 0.8\right)} \times h \quad \text{[Equation 4]}$$

Therefore, an electrical length (or effective length) Lf of the antenna pattern part may depend on the following Equation 5.

$$Lf = L + 2\Delta L \quad \text{[Equation 5]}$$

In the above Equation 5, L may represent an actual physical length of the antenna pattern part.

In addition, a width of the antenna pattern part may depend on the following Equation 6.

$$W = \frac{c}{2f_0}\sqrt{\frac{2}{\varepsilon_r + 1}} \quad \text{[Equation 6]}$$

The feeding pattern part 130 may be connected to the antenna pattern part 120 to electrically connect an external circuit to the antenna pattern part 120. The feeding pattern part 130 is connected to one side of the antenna pattern part 120, and thus may be formed in a line shape having a predetermined length.

The solder ball group 140 may include a plurality of solder balls disposed at predetermined intervals around the antenna pattern part 120.

The plurality of solder balls may connect and fix the substrate 110 to an external circuit substrate.

In more detail, contact surfaces of the solder balls are melted due to heat during the manufacturing process, such that the substrate 110 and the external circuit substrate may be connected and fixed to each other.

To this end, the plurality of solder balls may be disposed at predetermined intervals along the perimeter of the substrate.

Meanwhile, the plurality of solder balls may form an air cavity that may improve radiation characteristics of the antenna pattern part 120.

Therefore, the intervals between the plurality of solder balls may be kept to a preset distance.

In more detail, the signal transmitted and received by the antenna pattern part 120 may be a millimeter wave (mmWave) signal within several tens of GHz band.

A distance from a center of one solder ball to a center of another solder ball adjacent thereto among the plurality of solder balls may be smaller than 0.1 times the product of the wavelength of the signal transmitted and received by the antenna pattern part 120 and a preset permittivity (Sp<0.1 λg).

Therefore, in the case of the millimeter wave (mmWave) signal within several tens of GHz band, the plurality of solder balls disposed at the preset distance may be seen as a single continuous metal, such that the air cavity may be formed.

Figure 2:
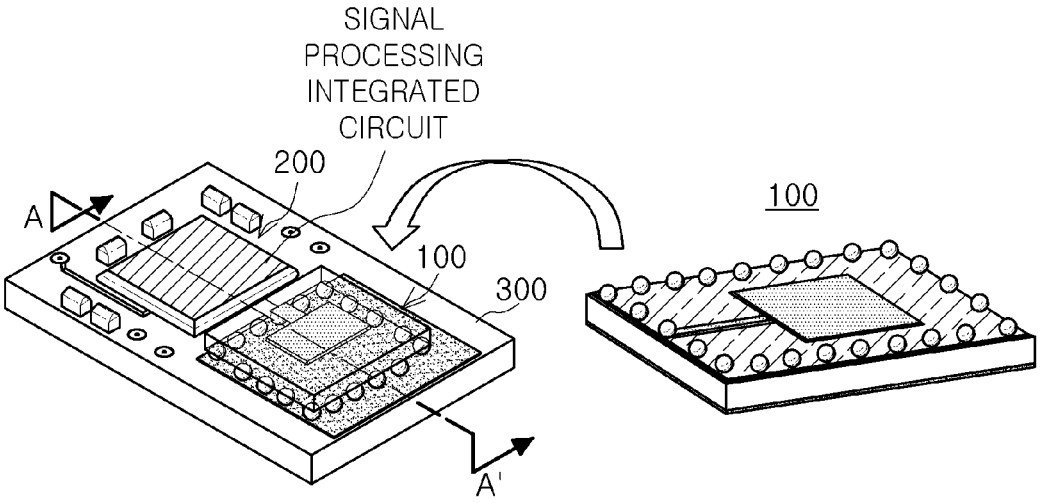
FIG. 2 is a schematic configuration diagram of a front end module according to an embodiment of the present invention.
Figure 3:
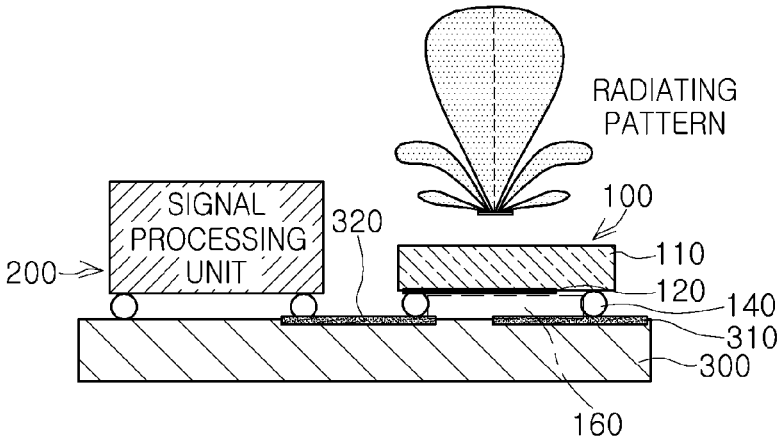
FIG. 3 is a cross-sectional view taken along line A-A' of the front end module according to the embodiment of the present invention illustrated in FIG. 2.

FIG. 2 is a schematic configuration diagram of a front end module according to an embodiment of the present invention. FIG. 3 is a cross-sectional view taken along line A-A' of the front end module according to the embodiment of the present invention illustrated in FIG. 2.

Referring to FIGS. 2 and 3, the front end module according to the embodiment of the present invention may include the antenna 100, a signal processing integrated circuit 200, and a circuit substrate 300.

The circuit substrate 300 may be formed of a dielectric substance such as a ceramic and one surface thereof may be provided with amounting area on which components are mounted. The antenna 100 and the signal processing integrated circuit 200 may be mounted on the mounting area.

The antenna pattern part 120 and the feeding pattern part 130 of the antenna 100 may be formed on a lower surface of the antenna 100, facing one surface of the circuit substrate 300 provided with the mounting area, and the antenna 100 may be connected to the circuit substrate 300 by the solder ball group 140 and fixed to the circuit substrate 300.

As described above, an air cavity is formed in a space between the lower surface of the antenna 100 and one surface provided with the mounting area of the circuit board 300, by the solder ball group 140.

The signal radiated by the antenna pattern part 120 is reflected within the air cavity 160, such that as illustrated, a radiation pattern may be formed upwardly.

The signal processing integrated circuit 200 may be formed of a single integrated circuit (IC) and may be disposed on one surface of the circuit substrate 300 provided with the mounting area.

The signal processing integrated circuit 200 may perform various types of signal processing, such as amplification of a signal transmitted and received through the antenna 100, frequency band filtering, and the like. For this purpose, the signal processing integrated circuit 200 may be electrically connected to the antenna 100 through a connection pattern part 320, formed on one surface of the circuit substrate 300.

In more detail, at least one of the plurality of solder balls of the solder ball group 140 disposed on the lower surface of the antenna 100 may be electrically connected to the feeding pattern part 130 and the connection pattern part 320.

As a result, the signal processing integrated circuit 200 is electrically connected to the antenna pattern part 120 through the connection pattern part 320 and the feeding pattern part 130 to process the signal transmitted and received by the antenna pattern part.

The mounting area on one surface of the circuit substrate 300 may be provided with a ground 310, connected to at least a portion of the plurality of solder balls of the solder ball group 140.

Figure 4:
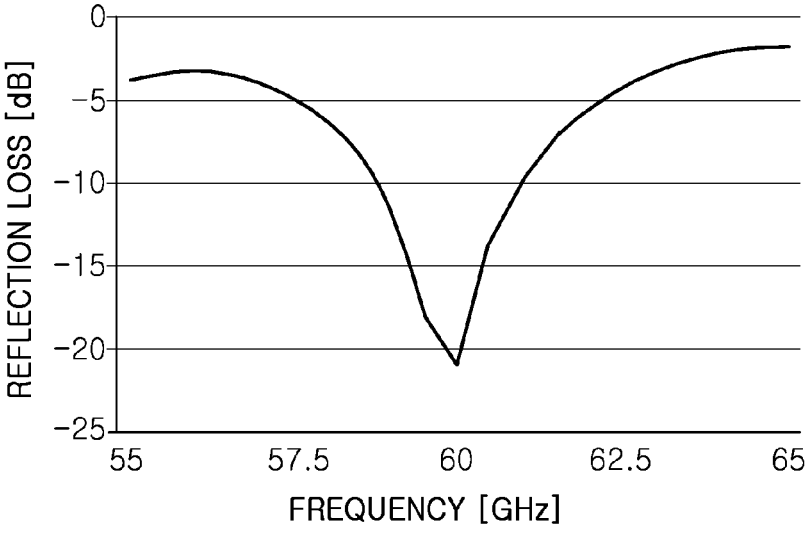
FIG. 4 is a graph illustrating a reflection coefficient of the antenna according to the embodiment of the present invention.
Figure 5:
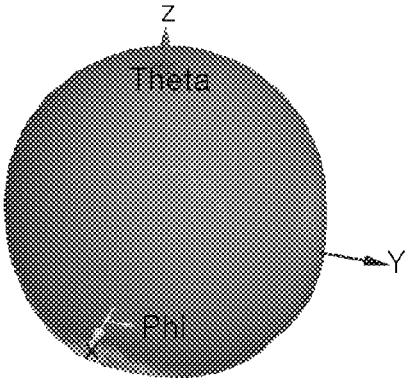
FIG. 5 is a diagram illustrating a radiation pattern of the antenna according to the embodiment of the present invention.

FIG. 4 is a graph illustrating a reflection coefficient of the antenna according to the embodiment of the present invention and FIG. 5 is a diagram illustrating a radiation pattern of the antenna according to the embodiment of the present invention.

It can be seen from FIG. 4 that the antenna according to the embodiment of the present invention have improved radiation characteristics due to the air cavity to improve reflection coefficient characteristics in a 60 GHz band used in, for example, the 801.11ad network standard.

Similarly, it can be seen from FIG. 5 that the radiation pattern for facilitating the transmitting and receiving of the signal is formed due to the air cavity.

As described above, according to the embodiment of the present invention, the antenna pattern part may be formed of only a metal conductor and may be directly connected to the signal processing integrated circuit to reduce radiation loss, and the air cavity can be formed due to the disposition of the plurality of solder balls to further reduce the radiation loss.

As set forth above, according to the embodiments of the present invention, radiation characteristics can be improved and a manufacturing process can be facilitated, by forming the air cavity and shortening a connection distance between the signal processing module and the antenna.

While the present invention has been shown and described in connection with the embodiments, it will be apparent to those skilled in the art that modifications and variations can be made without departing from the spirit and scope of the invention as defined by the appended claims.

What is claimed is:

1. An antenna, comprising:

a substrate having a preset mounting surface;

an antenna pattern part formed on the mounting surface of the substrate and transmitting and receiving a signal within a preset frequency band; and a solder ball group having a plurality of solder balls formed on the mounting surface of the substrate to fix the substrate to an external circuit board and disposed at preset intervals around the antenna pattern part to form an air cavity, wherein a distance between a center of one solder ball and a center of another solder ball adjacent thereto among the plurality of solder balls is determined according to a wavelength of the signal and a preset permittivity.

2. The antenna of claim 1, further comprising a feeding pattern part formed on the mounting surface of the substrate and electrically connected to the antenna pattern part to supply electricity.

3. The antenna of claim 1, wherein the signal transmitted and received through the antenna pattern part is a millimeter wave band signal.

4. The antenna of claim 1, wherein the respective solder balls of the solder ball group are disposed along a perimeter of the substrate.

5. An antenna, comprising:

a substrate having a preset mounting surface;

an antenna pattern part formed on the mounting surface of the substrate and transmitting and receiving a signal within a preset frequency band; and a solder ball group having a plurality of solder balls formed on the mounting surface of the substrate to fix the substrate to an external circuit board and disposed at preset intervals around the antenna pattern part to form an air cavity, wherein a distance between a center of the one solder ball and a center of the other solder ball adjacent thereto among the plurality of solder balls is smaller than 0.1 times a product of a wavelength of the signal and a preset permittivity.

6. A front end module, comprising:

a circuit board having one surface on which a mounting area is provided;

an antenna including a substrate having a preset mounting surface facing the mounting area of the circuit board, an antenna pattern part formed on the mounting surface of the substrate and transmitting and receiving a signal within a preset frequency band, and a solder ball group having a plurality of solder balls formed on the mounting surface of the substrate to fix the substrate to the mounting area of the circuit board and disposed at preset intervals around the antenna pattern part to form an air cavity; and a signal processing integrated circuit mounted on the mounting area of the circuit board to process the signal transmitted and received through the antenna, wherein a distance between a center of one solder ball and a center of another solder ball adjacent thereto among the plurality of solder balls is determined according to a wavelength of the signal and a preset permittivity.

7. The front end module of claim 6, wherein the antenna further includes a feeding pattern part, formed on the mounting surface of the substrate and electrically connected to the antenna pattern part to supply electricity.

8. The front end module of claim 6, wherein the signal transmitted and received through the antenna pattern part is a millimeter wave band signal.

9. The front end module of claim 6, wherein the respective solder balls of the solder ball group are disposed along a perimeter of the substrate.

10. The front end module of claim 6, wherein the mounting area of the circuit board is provided with a connection pattern part that transmits the signal between the antenna and the signal processing integrated circuit.

11. The front end module of claim 10, wherein the antenna further includes a feeding pattern part formed on the mounting surface of the substrate and electrically connected to the antenna pattern part to supply electricity, and at least one solder ball of the solder ball group electrically connects the feeding pattern part to the connection pattern part.

12. A front end module, comprising:

a circuit board having one surface on which a mounting area is provided;

an antenna including a substrate having a preset mounting surface facing the mounting area of the circuit board, an antenna pattern part formed on the mounting surface of the substrate and transmitting and receiving a signal within a preset frequency band, and a solder ball group having a plurality of solder balls formed on the mounting surface of the substrate to fix the substrate to the mounting area of the circuit board and disposed at preset intervals around the antenna pattern part to form an air cavity; and a signal processing integrated circuit mounted on the mounting area of the circuit board to process the signal transmitted and received through the antenna, wherein a distance between a center of the one solder ball and a center of the other solder ball adjacent thereto among the plurality of solder balls is smaller than 0.1 times a product of a wavelength of the signal and a preset permittivity.

* * * * *